US012285081B2

(12) United States Patent
Cross et al.

(10) Patent No.: US 12,285,081 B2
(45) Date of Patent: Apr. 29, 2025

(54) METHODS OF FORMING AN ARTICLE OF FOOTWEAR USING A GATHERING SYSTEM AND ARTICLES FORMED BY THE SAME

(71) Applicant: NIKE, Inc., Beaverton, OR (US)

(72) Inventors: Tory Cross, Portland, OR (US); Kassio Figur, Portland, OR (US); Guillermo Raffaele, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 101 days.

(21) Appl. No.: 17/847,062

(22) Filed: Jun. 22, 2022

(65) Prior Publication Data

US 2023/0000213 A1 Jan. 5, 2023

Related U.S. Application Data

(60) Provisional application No. 63/216,642, filed on Jun. 30, 2021.

(51) Int. Cl.

| | |
|---|---|
| ***A43D 91/00*** | (2006.01) |
| ***A43B 23/02*** | (2006.01) |
| ***A43D 9/00*** | (2006.01) |
| ***A43D 21/00*** | (2006.01) |

(52) U.S. Cl.

CPC ..... *A43D 91/00* (2013.01); *A43B 23/025* (2013.01); *A43D 9/00* (2013.01); *A43D 21/003* (2013.01)

(58) Field of Classification Search

CPC ..... A43D 91/00; A43D 3/022; A43D 9/00; A43D 21/003; A43B 9/02; A43B 23/0235; A43B 23/025; A43C 1/06

See application file for complete search history.

(56) References Cited

U.S. PATENT DOCUMENTS

| | | | | |
|---|---|---|---|---|
| 2018/0271214 | A1* | 9/2018 | Farris | A43B 23/0245 |
| 2019/0328086 | A1 | 10/2019 | Baptista De Souza | |
| 2020/0154816 | A1* | 5/2020 | Gaba | A43B 23/0235 |

FOREIGN PATENT DOCUMENTS

| | | | |
|---|---|---|---|
| EP | 3 569 089 | A1 | 11/2019 |
| GB | 28373 | A | 2/1912 |
| GB | 1253448 | A | 11/1971 |

OTHER PUBLICATIONS

International Search Report and Written Opinion, mailed Sep. 23, 2022, issued for International Patent Application No. PCT/US2022/35158, 13 pages.

* cited by examiner

*Primary Examiner* — Khoa D Huynh
*Assistant Examiner* — Erick I Lopez
(74) *Attorney, Agent, or Firm* — Klarquist Sparkman, LLP

(57) ABSTRACT

A method of forming an article of footwear can include providing an upper in a substantially flat orientation, securing a gathering string along at least a portion of a perimeter of a first surface of the upper with a securing member that is attached to the upper, positioning the upper on a last, and applying tension to the gathering string to at least partially conform the upper to a shape of the last.

18 Claims, 9 Drawing Sheets

METHODS OF FORMING AN ARTICLE OF FOOTWEAR USING A GATHERING SYSTEM AND ARTICLES FORMED BY THE SAME

CROSS REFERENCE TO RELATED APPLICATION

This application claims the benefit of U.S. Provisional Application No. 63/216,642, filed Jun. 30, 2021. The prior application is incorporated herein by reference in its entirety.

FIELD

This disclosure is directed to methods of manufacturing articles of footwear and the resulting articles and, and, in particular, to methods of forming uppers for attachment to sole structures and the resulting articles of footwear.

BACKGROUND

Articles of footwear can be formed in a variety of manners, including, for example, by attaching a strobel to an upper and securing a sole structure to a lower surface of the strobel. Strobel stitching is a complicated process that requires a high-degree of user skill to perform. Improvements to conventional footwear construction techniques that simplify construction and/or enhance the performance of the article of footwear and comfort of the wearer are desirable.

SUMMARY

The foregoing and other objects, features, and advantages of the invention will become more apparent from the following detailed description, which proceeds with reference to the accompanying figures.

DETAILED DESCRIPTION

General Considerations

Figure 1:
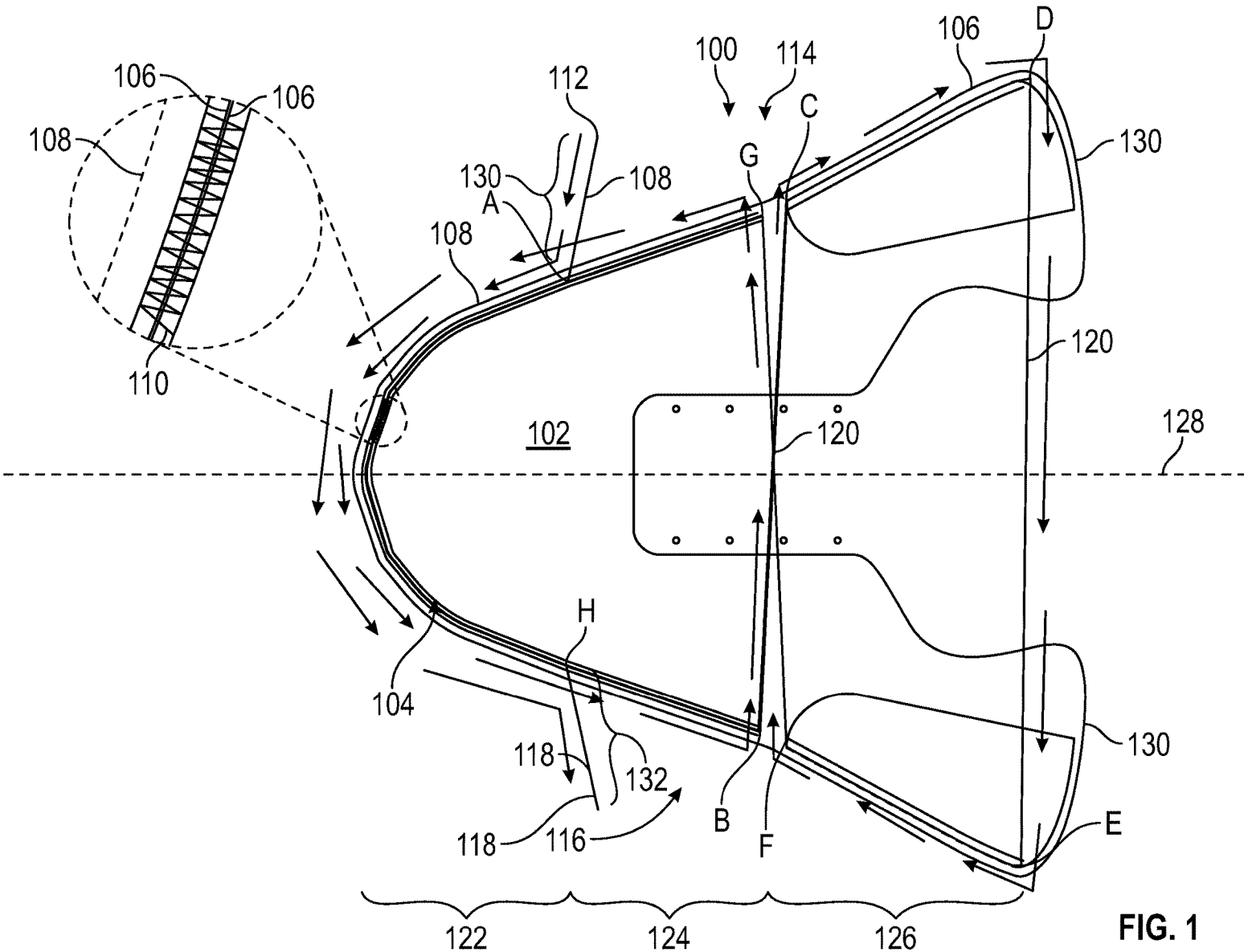
FIG. 1 illustrates an exemplary upper of an article of footwear in a flat orientation and with an exemplary gathering system.

The systems and methods described herein, and individual components thereof, should not be construed as being limited to the particular uses or systems described herein in any way. Instead, this disclosure is directed toward all novel and non-obvious features and aspects of the various disclosed embodiments, alone and in various combinations and subcombinations with one another. For example, any features or aspects of the disclosed embodiments can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application the singular forms "a," "an," and "the" include the plural forms unless the context clearly dictates otherwise. Additionally, the term "includes" means "comprises." Further, the term "coupled" or "secured" encompasses mechanical and chemical couplings, as well as other practical ways of coupling or linking items together, and does not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide" and "produce" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the directional terms (e.g., "upper" and "lower") generally correspond to the orientation of an article of footwear or sole assembly as it is configured to be worn by a wearer. For example, an "upwardly-facing surface" and/or an "upper surface" of a sole assembly refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body." "Longitudinal axis" refers to a centerline of the article from the heel to toe. Similarly, a "longitudinal length" refers to a length of the article along the longitudinal axis and a "longitudinal direction" refers to a direction along the longitudinal axis.

As used herein, the term "perimeter" (sometimes referred to as the "outer perimeter") refers to an area forming the boundary of the object referred to. For example, a perimeter of a flat upper is the area that extends along the boundary of that upper. The perimeter, as used herein, includes the edge that defines the outer boundary as well as an area inbound of the edge that can receive at least some portions of the gathering system as described herein.

The term "perimeter direction" refers to a direction that extends generally along the perimeter of an upper and can vary along different locations along the perimeter. For example, the perimeter direction of an upper at a particular location along the perimeter extends towards immediately adjacent locations along the perimeter of that upper.

As used herein, the term "gathering system" refers to a structure that includes a string, cord, cable, or other elongate member (generally referred to as a "gathering string") that is movably secured to a portion of the upper. "Movably secured," as used herein, means that an element (e.g., gathering string) is movable along at least one direction (e.g., a peripheral direction) relative to another structure (e.g., the upper), while being at least party constrained in at least one other direction (e.g., a lateral or medial direction) by one or more "securing members." In some embodiments, the "securing member" can comprise a series of stitches that extend over at least a portion of the gathering string.

As used herein, the term "gathering string path" refers to a path in which the gathering string extends and includes a first portion that is at least partially enclosed by securing member(s) (e.g., a "secured portion" of the gathering string path) and a second portion that in which the gathering string is not enclosed by securing members (e.g., an "unsecured portion" of the gathering string path). As used herein, the term "gathering pattern" refers to a pattern associated with the gathering string path. As will be understood from the disclosure here, the gathering pattern can vary depending on the location of the securing members As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole and an inner sole.

As used herein, the term "fixedly attached" refers to two components joined in a manner such that the components may not be readily separated from one another without destroying and/or damaging one or both of the components. Exemplary modalities of fixed attachment may include joining with permanent adhesive, stitches, welding, or other thermal bonding, and/or other joining techniques. In addition, two components may be "fixedly attached" by virtue of being integrally formed, for example, in a molding process. In contrast, the term "temporarily attached," or "temporarily fixed," refers to two components joined in a manner such that the components can be readily separated from one another to return to their separate, discrete forms without destroying and/or damaging either component. Exemplary modalities of temporary attachment may include removable stitches or other temporary joining techniques.

As used herein, the terms "flat-formed" and "flat-forming process" refer to manufacturing methods in which a structure (e.g., an upper or portion thereof) is maintain in a substantially two-dimensional shape for at least a portion of its construction and/or assembly. Subsequently, the structure can be manipulated into a three-dimensional form for final assembly. For example, a flat-formed upper can be manipulated from the two-dimensional shape into a three-dimensional form to receive a sole structure.

Although the figures may illustrate an article of footwear intended for use on only one foot (e.g., a right foot) of a wearer. One skilled in the art will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, claims, abstract, and drawings.

The Disclosed Technology

Various methods of forming an article of footwear using gathering systems and articles of footwear formed using the gathering systems are described herein.

In one embodiment, a method of forming of an article of footwear is provided. The method includes providing an upper in a substantially flat orientation, securing a gathering string along at least a portion of a perimeter of a first surface of the upper with a securing member that is attached to the upper, the gathering string being movable relative to the securing member, positioning the upper on a last, and applying tension to the gathering string to at least partially conform the upper to a shape of the last.

In some embodiments, the gathering string comprises at least one crossing portion that extends from a first location along the perimeter of the upper to a second location along the perimeter of the upper. The first location is spaced apart from the second location of the upper, such as from a medial side to a lateral side of the upper. In some embodiments, two or more crossing portions can be provided, and in some cases, the two or more crossing portions can intersect. The intersection can be at one or more of a midfoot region, a heel region, and/or a forefoot region.

In some embodiments, the securing member comprises a plurality of stitches that capture the gathering string along the at least a portion of the perimeter, such as along at least 50 percent, 60%, 70%, or 80% of the perimeter of the upper. In some embodiments, the gathering string has a first portion that overlaps with a second portion along the perimeter of the upper, either in an adjacent manner or spaced apart from one another to define separate paths. The article of footwear can include a sole structure attached to the upper after applying tension to the gathering string.

In another embodiment, an article of footwear is provided that includes an upper, a gathering string extending along at least a portion of a perimeter of a first surface of the upper, and a sole structure secured to the upper so that at least a portion of the gathering string is secured between the sole structure and the upper. The gathering string can be in tension so that the upper conformed to a last during construction of the article.

In some embodiments, a securing member, such as a plurality of stitches, are attached to the upper with at least a portion of the securing member being secured between the sole structure and the upper. The securing member extends along at least a portion of the gathering string to maintain the gathering string along the perimeter during construction of the upper.

Exemplary Embodiments of the Disclosed Technology

FIG. 1 illustrates an upper 100 of an article of footwear with an exterior surface 102 on which a gathering system 104 has been provided. The gathering system 104 includes a gathering string 106 that extends along at a portion of an outer perimeter 108 of the upper 100.

Upper 100 may include one or more material elements (for example, textiles, foam, leather, and synthetic leather), which may be stitched, adhesively bonded, molded, or otherwise formed to define an interior void configured to receive a foot. The material elements may be selected and arranged to selectively impart properties such as durability, air-permeability, wear-resistance, flexibility, and comfort.

As shown in FIG. 1, the gathering string 106 is at least partially constrained in portions of the perimeter by a securing members 110. The securing members 110 comprise a plurality of stitches that capture the gathering string 106 between a portion of the stitches that extend over the gathering string 106 and the exterior surface 102 of the upper 100.

Various securing members can be used so long as the securing member is capable of moveably securing the gathering string at or adjacent to at least a portion of the perimeter of the upper as disclosed herein. Although the stitch may extend over the perimeter edge in some embodiments, the securing member preferably is positioned entirely inward from the perimeter edge of the upper. That is, in some embodiments, unlike some conventional stroebel stitching methods where a portion of the securing member (e.g., stitch) extends over an edge of the upper to secure the upper to a sole structure, the securing member can be positioned inward of the perimeter edge and is not secured to the sole structure. In this manner, a portion of the upper extends from an outwardmost edge of the stitch to the perimeter edge.

Figure 2:
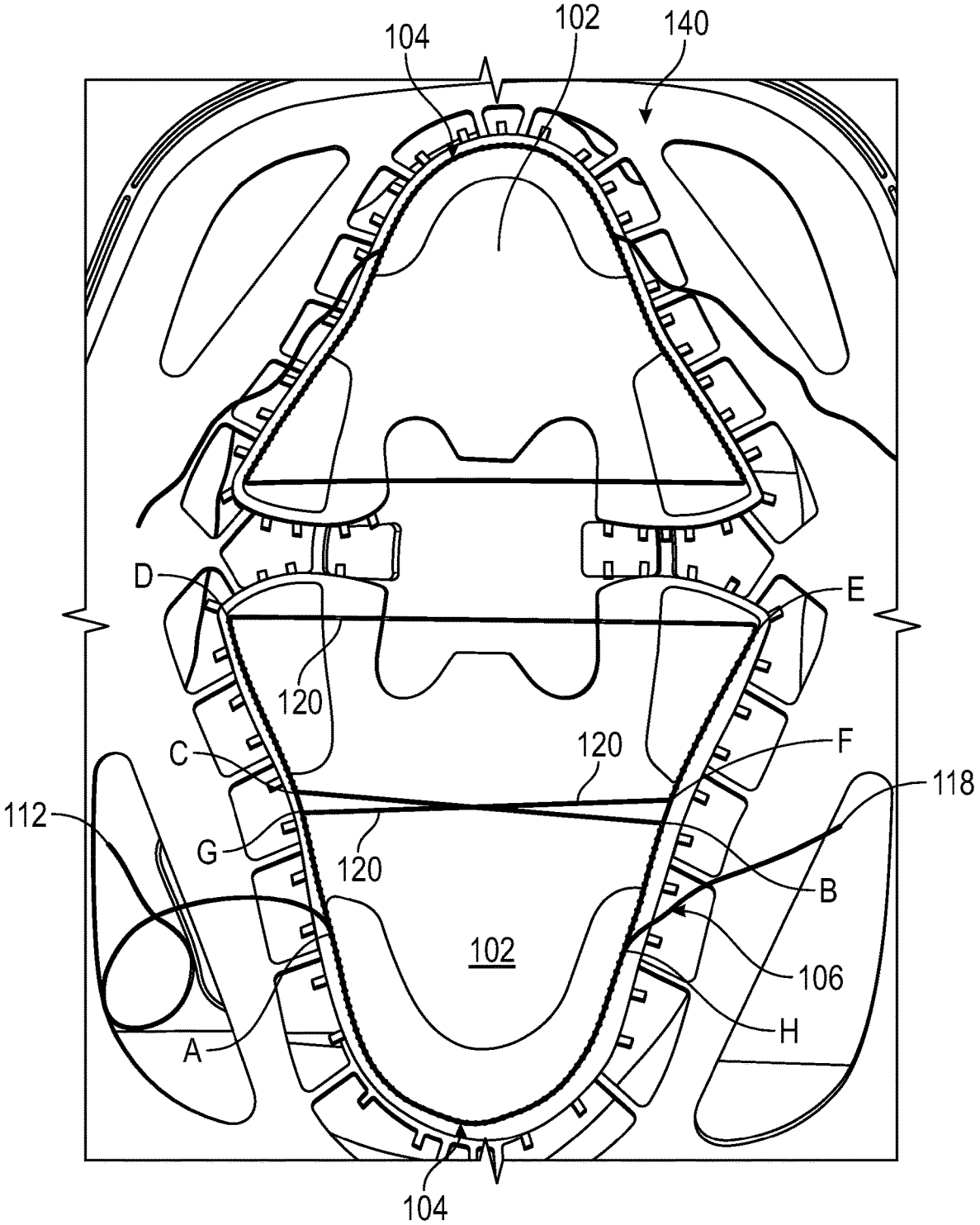
FIG. 2 illustrates a pair of exemplary uppers of articles of footwear in flat orientations and with exemplary gathering systems.

Providing a portion of the upper that extends outward from the securing member can facilitate application of the securing member. For example, in some embodiments, the upper may include one or more tab portions that extend outward for retention of the upper in the flat configuration by another structure (e.g., a form 140 as shown in FIG. 2). Alternatively, or in addition to tabs, the upper can be retained in a flat configuration by other means, such as pockets formed along the perimeter edge (e.g., by folding over a portion of the upper) that receive an extending member of a form, holes that receive one or more pins, and/or removable stitches applied at an outwardly extending portion of the upper. As discussed in more details below, in some embodiments, portions of the upper that extend outward from the secured portion can be removed before attaching a sole structure to the upper.

In embodiments where the securing member comprises a stitch, the stitch can be any stitch suitable to movably retain the gathering string for the purposes described herein. Preferably, the stitch provides a pathway (e.g., a tunnel or passageway) in which the gathering string is at least partially enclosed. In some embodiments, the stitch can be a lock stitch that does not extend over the perimeter edge of the upper.

The gathering system 104 can be applied to the upper 100 as part of a flat-forming process of the upper (e.g., while the upper is maintained in a substantially flat condition). Referring to FIG. 1, an exemplary gathering pattern is provided. A gathering pattern is a pattern associated with the gathering string path and, in some embodiments, can include portions of the gathering string path that are secured or unsecured by the securing members (e.g., stitching). In some areas, the unsecured portions can also be crossing portions in which the gathering string crosses from one side of the upper to another (e.g., from a medial side to a lateral side). For example, the upper 100 reflected in FIG. 1 includes a first side 114 (e.g., a medial side) and a second side 116 (e.g., lateral side).

The gathering string 108 has a first end 112 and a second end 118, and the gathering string 108 is secured along at least a portion of the first side 114 (e.g., a medial side) and at least a portion of the second side 116. In addition, between the first and second ends 112, 118, there are at least two crossing portions 120 that extend across the exterior surface 102 between the first and second sides 114, 116.

The exemplary gathering system 104 is described below by the path in which the gathering string 106 is secured to the upper 100 by the securing members 110. For convenience, the upper 100 is described as having a forefoot region 122, a midfoot region 124, and a heel region 126. Any suitable system for applying the securing members 110 to the outer perimeter 108 of the upper 100 and thereby capturing the gathering string 106 can be used. For example, in the disclosed embodiment, the gathering string 106 is capture by a plurality of stitches that extend along outer perimeter. The laying of the gathering string 106 and application of the stitches can be achieved, for example, by an embroidery machine or the like.

In FIG. 1, the embroidery machine begins capturing the gathering string 106 at location A on the first side 114 and continue in the direction of the arrows along the outer perimeter 108 in the forefoot region 122 and continue on the second side 116 moving in the direction of the heel region 126. At location B, the gathering string 106 can move across the exterior surface 102 of the upper 100 back to the first side at location C. The gathering string 106 defines a first crossing portion 120 between locations B and C. In some embodiments, locations B and C are offset from each other relative to a longitudinal axis 128 of the upper 100. For example, as shown in FIG. 1, location B is closer to the forefoot region than location C.

From location C, the gathering string 106 is captured along the outer perimeter 108 in the direction of heel region 126. At location D, near a heel end 130 of the first side 114 of the upper 100, the gathering string 106 can move back across the exterior surface of the upper to location E on the second side 116 of the upper 100, thereby forming a second crossing portion 120 between locations D and E.

From location E, the gathering string 106 is captured along the outer perimeter 108 of the second side 116 moving towards the forefoot region 122. At location F on the second side 116, the gathering string 106 can move back across the exterior surface of the upper to location G on the first side 114 of the upper 100, thereby forming a third crossing portion 120 between locations F and G. As noted above with the first crossing portion, locations F and G can be offset from each other relative to a longitudinal axis 128 of the upper 100.

From location G, the gathering string 106 is captured along the outer perimeter 108 of the second side 114 moving again towards the forefoot region 122, along the outer perimeter 108 along the forefoot region 122 and back over to the second side 116 to a location H, with the second end 118 extending away from location H. As shown in FIG. 1, a first free portion 130 is formed between first end 112 and location A, and a second free portion 132 is formed between second end 118 and location H.

Figure 7:
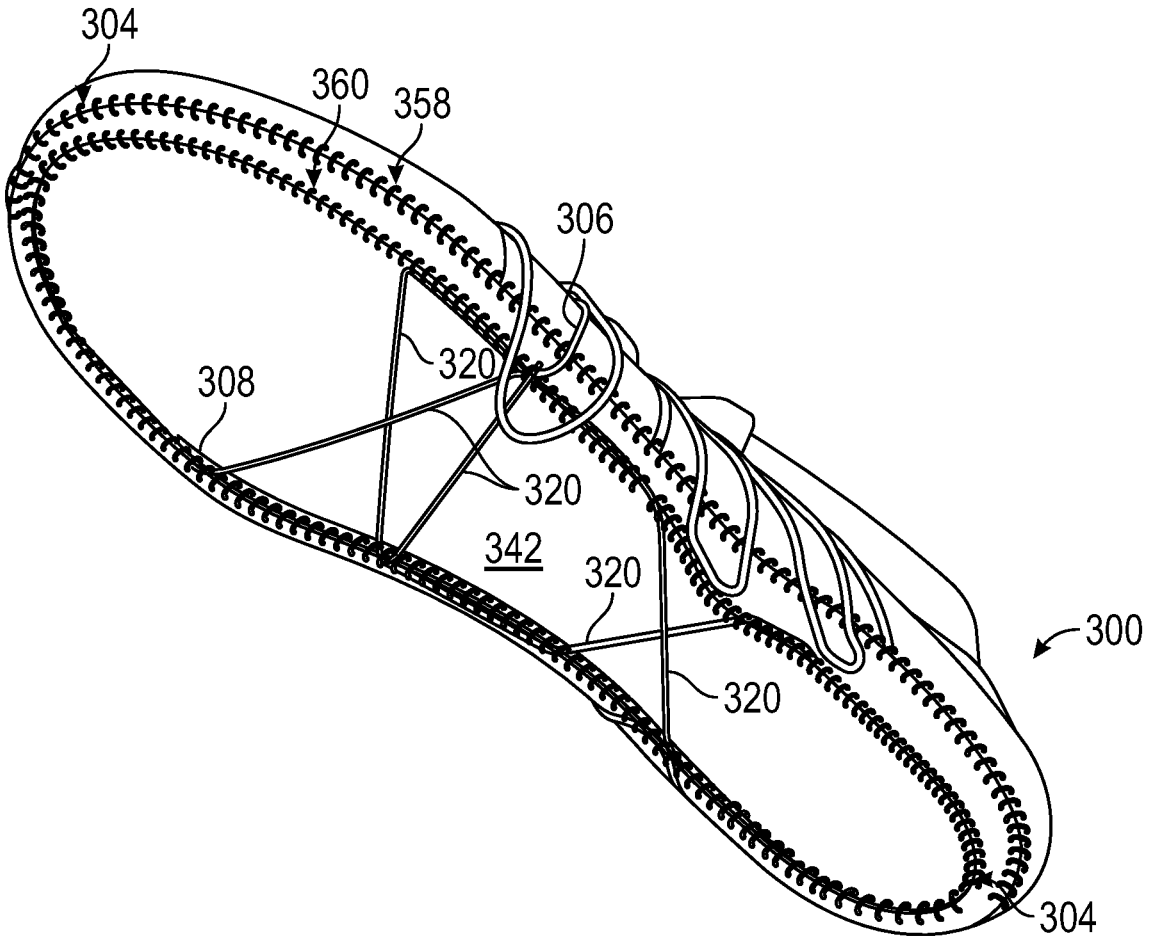
FIG. 7 illustrates another exemplary upper positioned on a last with another exemplary gathering system conforming the upper to the shape of the last.

In some embodiments, a portion of the gathering string can overlap with another portion of the gathering string along the outer perimeter. For example, as described above, the portion of the gathering string that extends between locations A and B at least partially overlaps with the portion of the gathering string that extends between locations G and H. In some embodiments, overlapping portions can be offset from one another so that one of the portions is closer to the outer perimeter the other at a particular location along the outer perimeter (e.g., as shown in FIG. 7). Alternatively, the overlapping portions can include a first securing portion entirely positioned within a second securing portion (e.g., the second securing portion has a wider stitch that extends across the entirety of the first securing portion) or the overlapping portions can include a first securing portion that partially overlaps with the second securing portion (e.g., either with or without the strings in the overlapping portion of the two securing portions).

Alternatively, the gathering string can have no overlapping portions. For example, referring to FIG. 1, rather than crossing and returning to the forefoot region for a second "pass" between location G and H, the gathering string could start at location A, extend along the forefoot region to location B, cross to location C, extend to location D, cross to location E, and finish at location F with a portion of the gathering string extending from location F to provide the second free end.

In some embodiments, two or more different crossing portions 120 can intersect (e.g., cross over) one another between the first and second sides 114, 116. In other words, when viewed from above, two crossing portions 120 can have a point of intersection with each other where one crossing portion overlaps with another crossing portion.

FIG. 2 illustrates another embodiment of the gathering system discussed above in which one or more uppers 100 are secured to and/or by a form 140 (e.g., a frame or jig) to help maintain the uppers in position and/or help guide the application of the gathering string and/or securing members to the upper.

After the gathering system 104 is applied to the upper 100, the upper 100 can be formed on a last 142 by positioning the upper 100 on the last 142 and moving the crossing portions 120 to a sole side of the upper 100. A last, such as last 142, is a tool form about which an article of footwear can be constructed and which, at least in part, can define the contours, shape, style, and other characteristics of a resulting article of footwear. For example, an interior volume of the lasted upper 100 is received on last 142 for further processing as described herein, including forming the outer perimeter of the upper into the shape of the last and adding a sole structure.

Depending on the construction of the upper 100, one or more additional processing steps may be performed before manipulating the gathering system to form the desired three-dimensional shape of the upper. For example, in the embodiment of FIG. 3A, the two sides of the heel 130 can be secured together, such as by stitching 144. Stitching 144 or other steps in the process of forming the three-dimensional shape of the upper can be performed on the last or prior to placement of the upper on the last. When the heel portions are stitched together, the crossing portion 120 at the heel region can be substantially closed by tightening the gathering string.

Figure 3A:
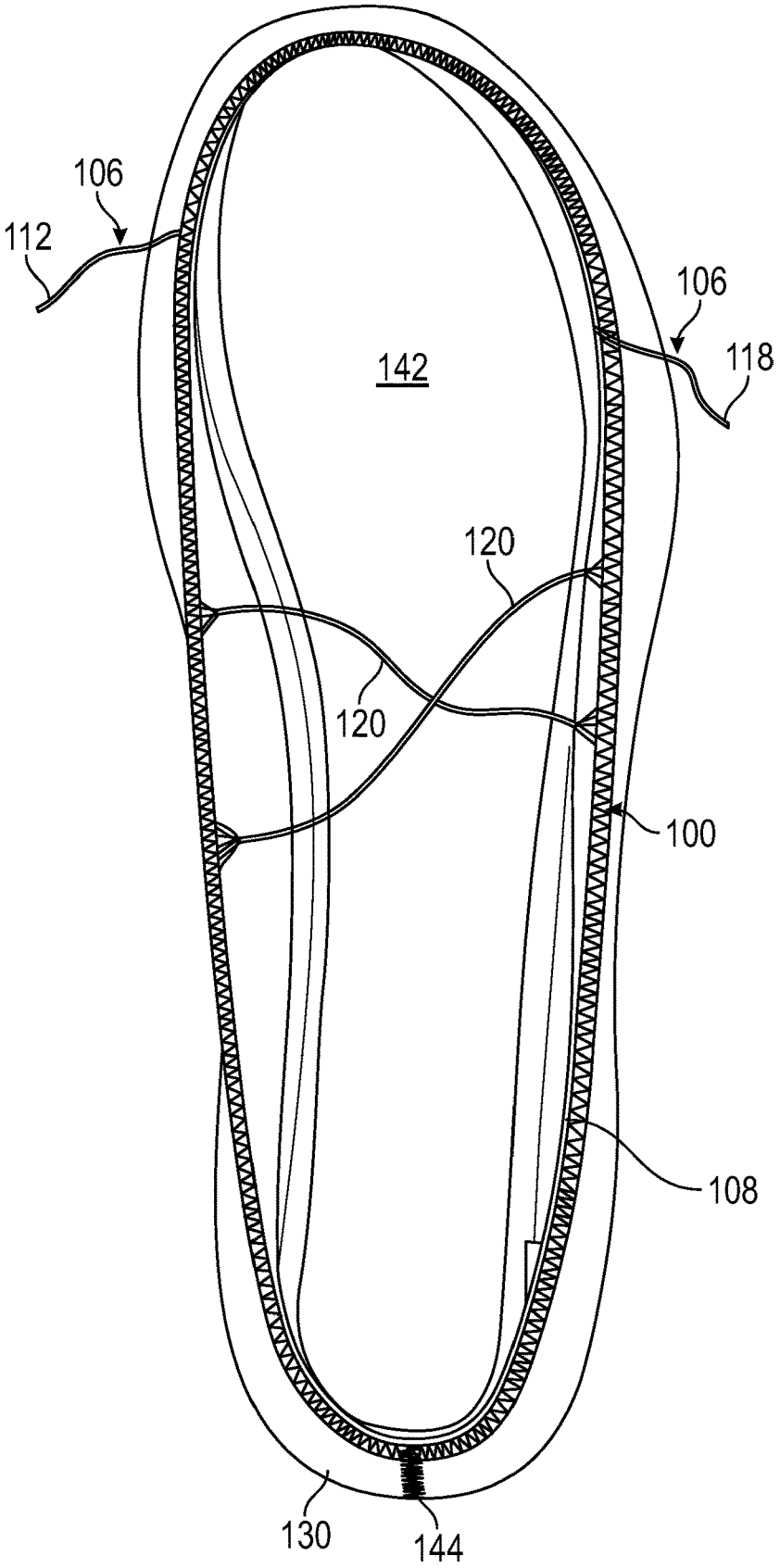
FIG. 3A illustrates an exemplary upper positioned on a last with an exemplary gathering system loosely holding the upper in place on the last.
Figure 3B:
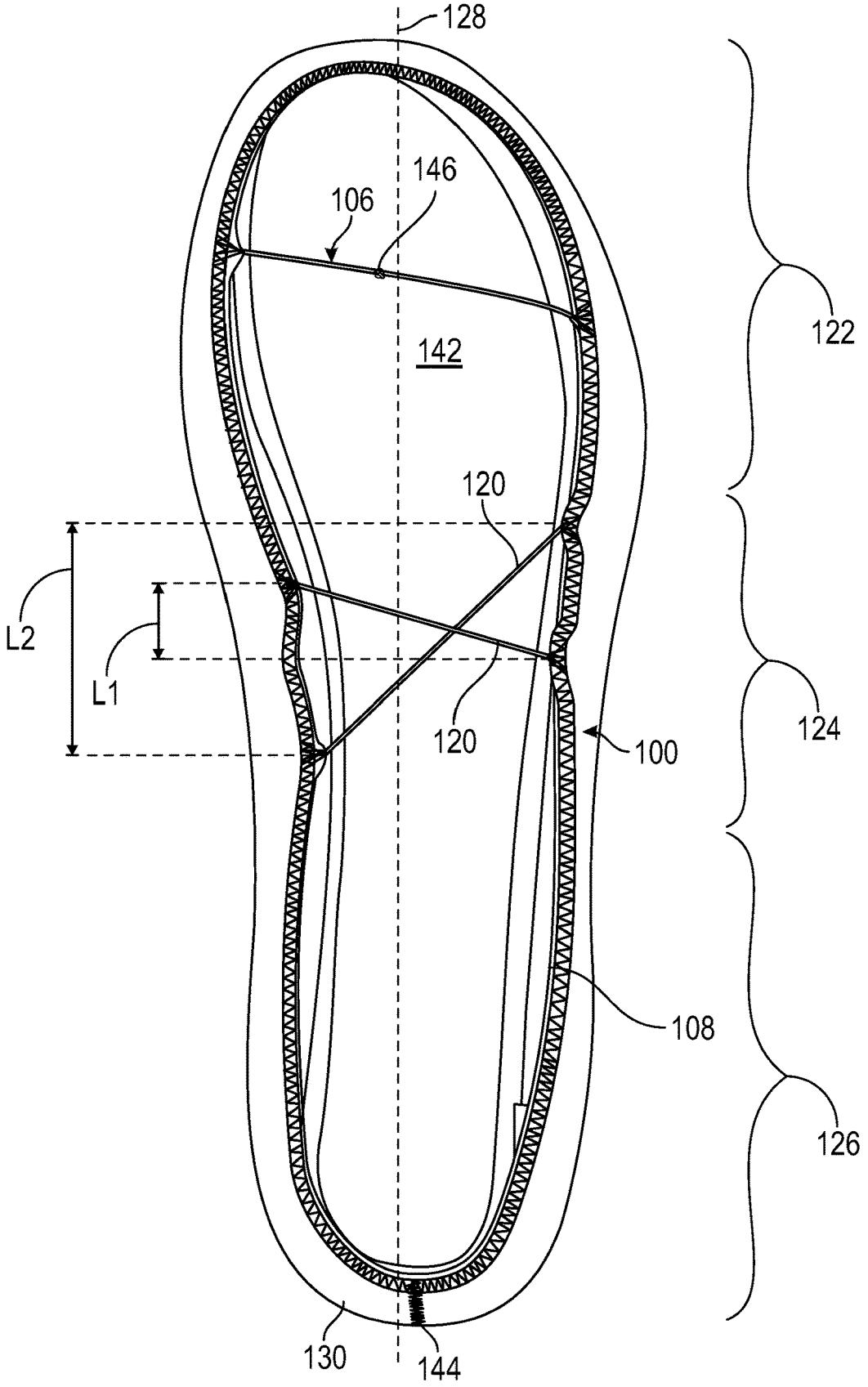
FIG. 3B illustrates the upper of FIG. 3B with the exemplary gathering system tightened so that the upper conforms to the shape of the last.

FIG. 3A illustrates the upper 100 positioned on a last 142 with the crossing portions 120 moved to the sole side of the upper 100. The two ends 112, 118 of the gathering string 106 can be pulled to tighten the gathering string, which in turn pulls the outer perimeter of the upper 100 to conform to the shape of the last 142. As shown in FIG. 3B, for example, the upper 100, including its outer perimeter, conforms to the shape of the last 142.

Referring to FIG. 3B, the two crossing portions 120 pull opposing sides of the outer perimeter 108 of the upper 100 towards each other, which further helps conform the upper 100 to the last 142. The number of crossing portions can vary, as can the location of crossing portions along the medial and lateral sides of the upper. For example, as shown in FIG. 3B, two crossing portions 120 are provided in the midfoot region 124. Crossing portions in the midfoot region can be helpful to conform the upper in the region of the arches on the last since that is a region, in some articles, that the upper may be required to narrow more to conform to the last. Depending on the article of footwear, however, one or more crossing portions can be alternatively, or additionally, provided in other areas. For example, one or more crossing portions can be provided in one or more of a forefoot, midfoot, and/or heel region.

In addition, as discussed above, the crossing portions can be offset relative to the longitudinal axis. This offset can be helpful to further conform the upper to the last. For example, FIG. 3B illustrates two crossing portions 120, with one being offset by a distance L1 and the second being offset by a distance L2. In the embodiment shown in FIG. 3B, L1 is less than L2; however, the distances could be the same if desirable. Alternatively, in some embodiments the offset of a crossing portion can be substantially zero, such that the locations on each side are substantially at the same location relative to the longitudinal axis.

As discussed herein, the gathering system includes a secured portion of the gathering string that extends along portions of the outer perimeter 108 of the upper 100. Preferably, the outside edge of the secured portion is 2 cm or less from the outer perimeter. Positioning the secured portion close to the outer perimeter edge can, for example, reduce bunching of material when the upper is formed into its three-dimensional shape. In some embodiments, it may be helpful to remove portions of the upper between the outer perimeter and the secured portion of the gathering system to reduce the gap between the outer perimeter and the secured portion. For example, to reduce the distance between the outer perimeter and secured portion, the portion therebetween can be trimmed.

Figure 4:
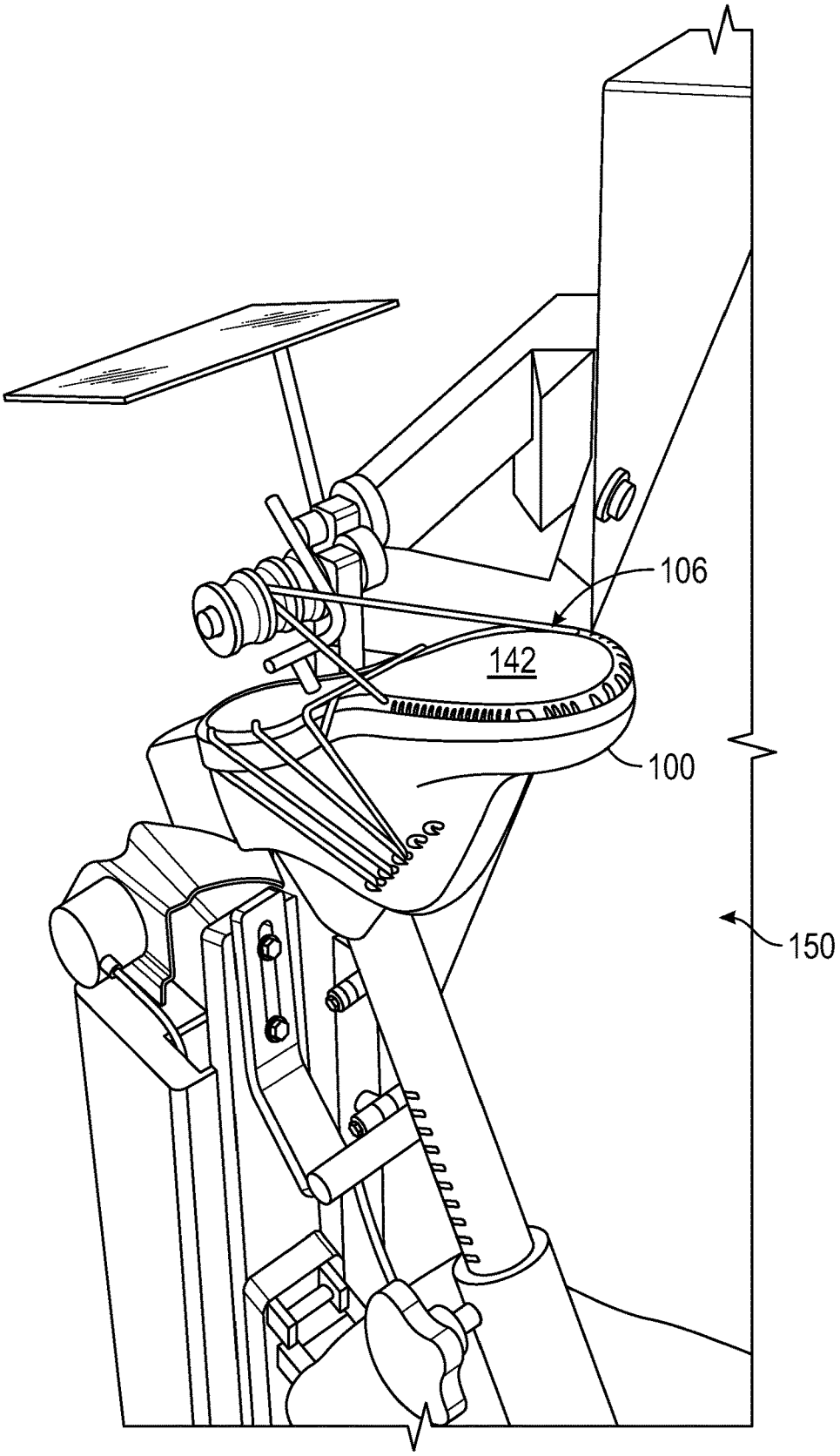
FIG. 4 illustrates an exemplary fastening system that can apply a force to the gathering string to conform the upper to the last.

Tightening of the gathering system can be achieved by any suitable system that can apply suitable pressure to the ends of the gathering string to conform the upper to the last. For example, FIG. 4 illustrates a fastening system 150 that gathers the two gathering string ends and applies a force to conform the upper 100 to the last 142.

After the gathering system is tightened (FIG. 3B), a sole structure can be applied to upper. To maintain the tightened upper configuration, the two ends of the gathering string can be secured to the upper and or to each other in some manner (e.g., tied and/or secured by any other coupling mechanism such as a mechanical fastener, adhesive, and/or a suitable thermal process). FIG. 3B illustrates the two ends secured by a knot 146.

Alternatively, the upper can be maintained in the desired three-dimensional form without continuous application of force to the gathering string and/or without securing the gathering strings at its ends. For example, the gathering string can be selected to have sufficient friction in contact with the securing members to hold the upper in the desired three dimensional form until a sole structure is attached.

Figure 5:
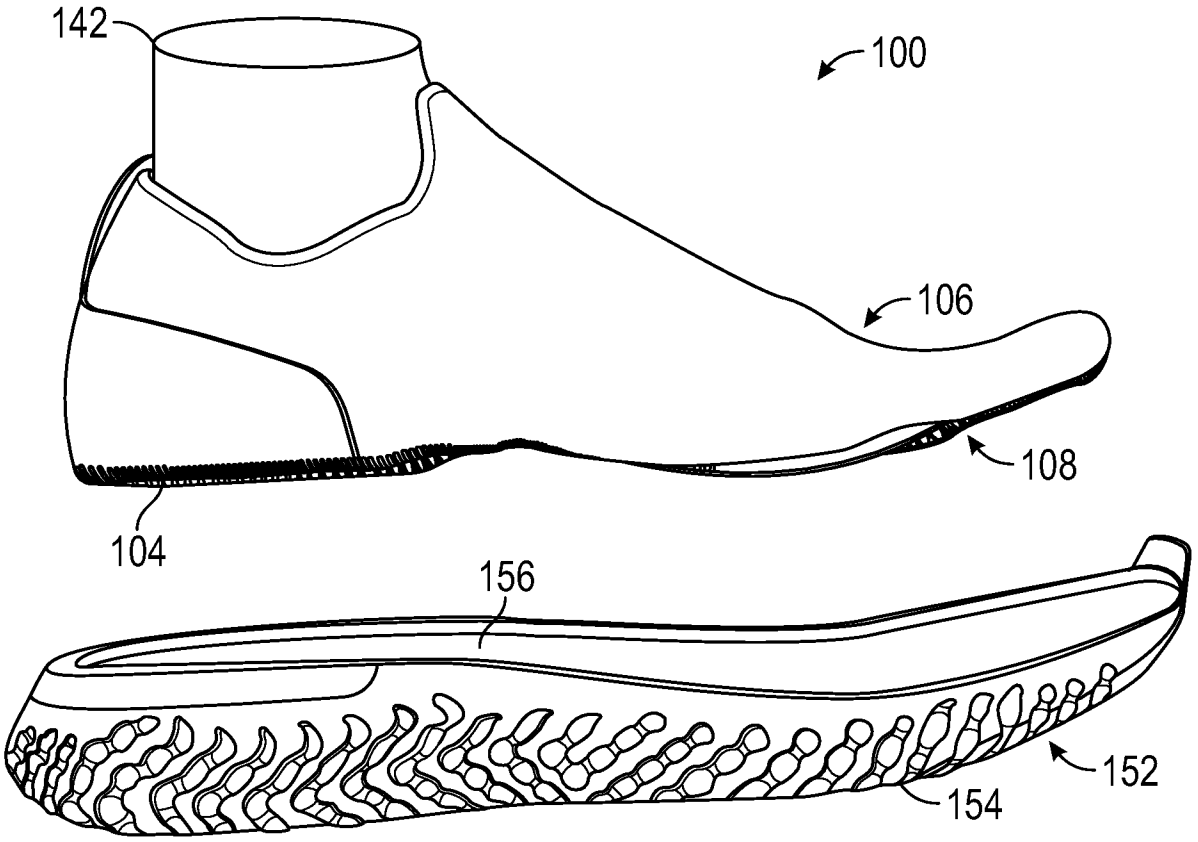
FIG. 5 illustrates a lasted upper and a sole structure that can be secured to a surface of the lasted upper.

FIG. 5 illustrates an upper 100 on a last 142, with a sole structure 152 adjacent the upper 100 for application thereto. Sole structure 104 has a lower surface 154 (e.g., a ground contacting surface) and an upper surface 156. Although sole structure 152 is illustrated as a single structure in the embodiments that follow, other types of sole structures can be used, such as, for example, any combination of an outsole, midsole, and inner sole. As shown in FIG. 5, after a lower surface of the lasted upper 100 is coupled to the upper surface 156 of the sole structure 152, the article of footwear can be removed from the last 142. The upper can be secured to the sole structure in any suitable manner, including for example, by adhesives, mechanical bonding, and the like. For example, cement, or other bonding materials, can be applied to the outer perimeter of the upper and the upper can be secured to the upper surface 156 of the sole structure 152.

The construction of the upper described herein can eliminate the need for an insole and in some embodiments, the article of footwear has a midsole that is in direct contact with the foot of a wearer. Alternatively, if desired, an insole, such as sockliner, can be provided within the void of the article of footwear to provide additional support and/or cushioning. The sockliner can comprise one or more layers of material and/or be formed in a unitary construction that can be placed inside the article of footwear.

Figure 6:
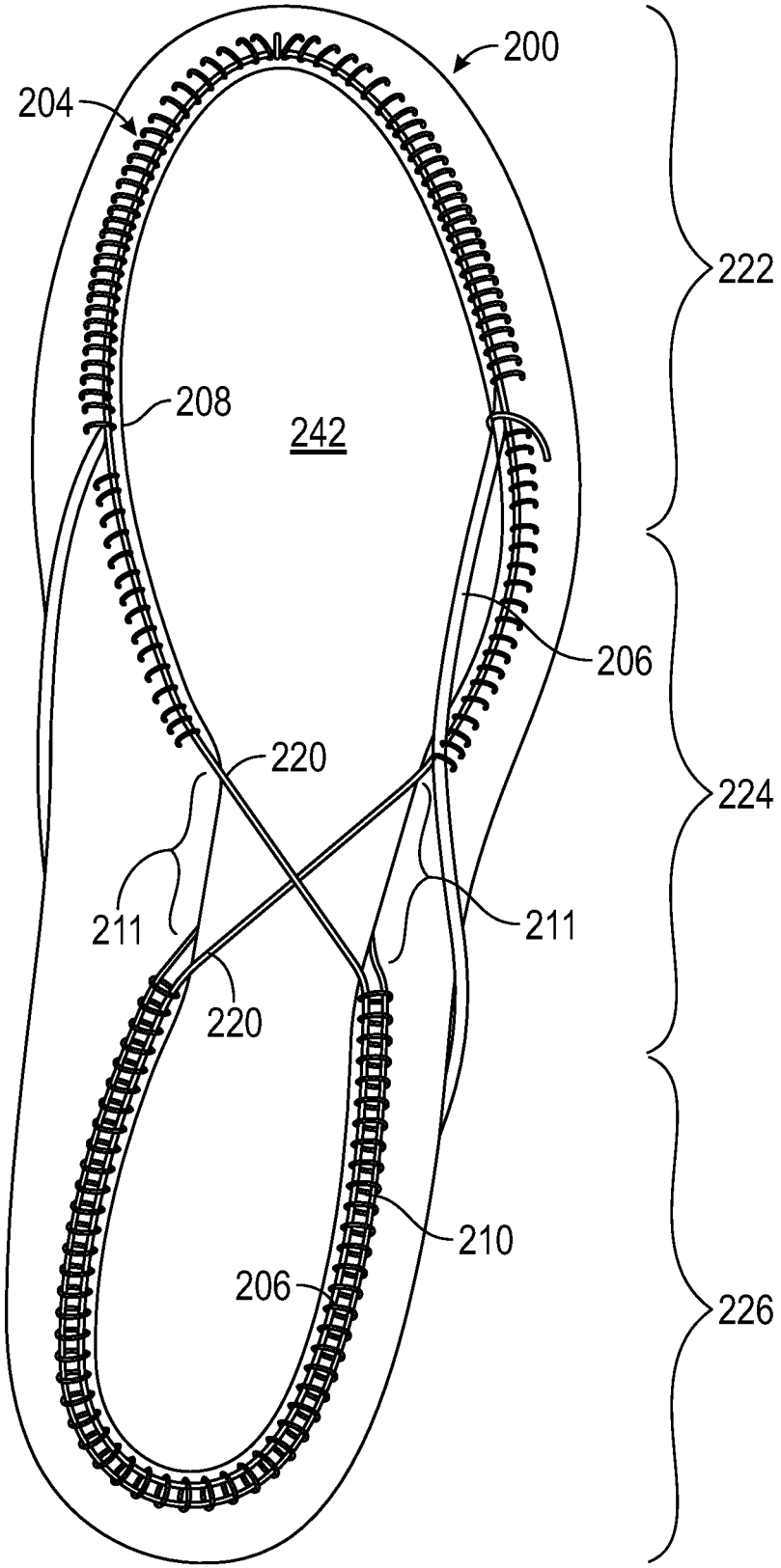
FIG. 6 illustrates another exemplary upper positioned on a last with another exemplary gathering system conforming the upper to the shape of the last.

FIG. 6 illustrates another exemplary upper 200 positioned on a last 242 with a pair of crossing portions 220 moved to the sole side of the upper 100. The gathering system 204 includes a secured portion of the gathering string 206 that extends along portions of the outer perimeter 208 of the upper 200. A force is applied to the gathering string 206 (e.g., at the two ends) to tighten the gathering string, which in turn pulls the outer perimeter of the upper 200 to conform to the shape of the last 242 as shown in FIG. 6.

As in other embodiments, crossing portions can be provided to facilitate conforming the upper to the last in different portions of the article. In FIG. 6, crossing portions 220 pull opposing sides of the outer perimeter 208 of the upper 200 towards each other in the midfoot region 224.

FIG. 7 illustrates another exemplary upper 300 positioned on a last 342. The gathering system 304 includes a secured portion of the gathering string 306 that extends along an area of the outer perimeter 308 of the upper 300. In this embodiment, portions of the gathering string 306 are spaced apart at the perimeter 308 of the upper 300. For example, as shown in FIG. 7, the gathering string path includes an external path 358 and an internal path 360. The external path 3658 is spaced apart from the internal path 360 with the external path being closer to the perimeter 308. In some embodiments, the same gathering string 306 can extend through both the external and internal paths 358, 360. For example, in the embodiment shown in FIG. 7, the gathering string 308 can first form the external path and then cross over to form the internal path (or vice versa). In other embodiments, a first gathering string can define the external path and a second gathering string can define the internal path. In such an embodiment, both first and second strings can be tightened together (sequentially and/or simultaneously) to conform the upper to the last 342. Two or more spaced apart paths, as shown in FIG. 7, can, in some cases, help the upper conform more closely to the shape of the last. In some embodiments, one or both of the two paths can be non-overlapping (along the perimeter direction). For example, the first path can extend along the entire perimeter while the second path only extends in one or more of the forefoot, midfoot, or heel regions.

FIG. 7 also illustrate an exemplary embodiment in which more than two crossing portions 120 intersect (e.g., cross over) one another between the first and second sides 114, 116. For example, FIG. 7 illustrates a two pairs of crossing portions 320. One pair is in the region of the arches in the midfoot and the other pair is positioned closer to (or in) the forefoot region.

Figure 8:
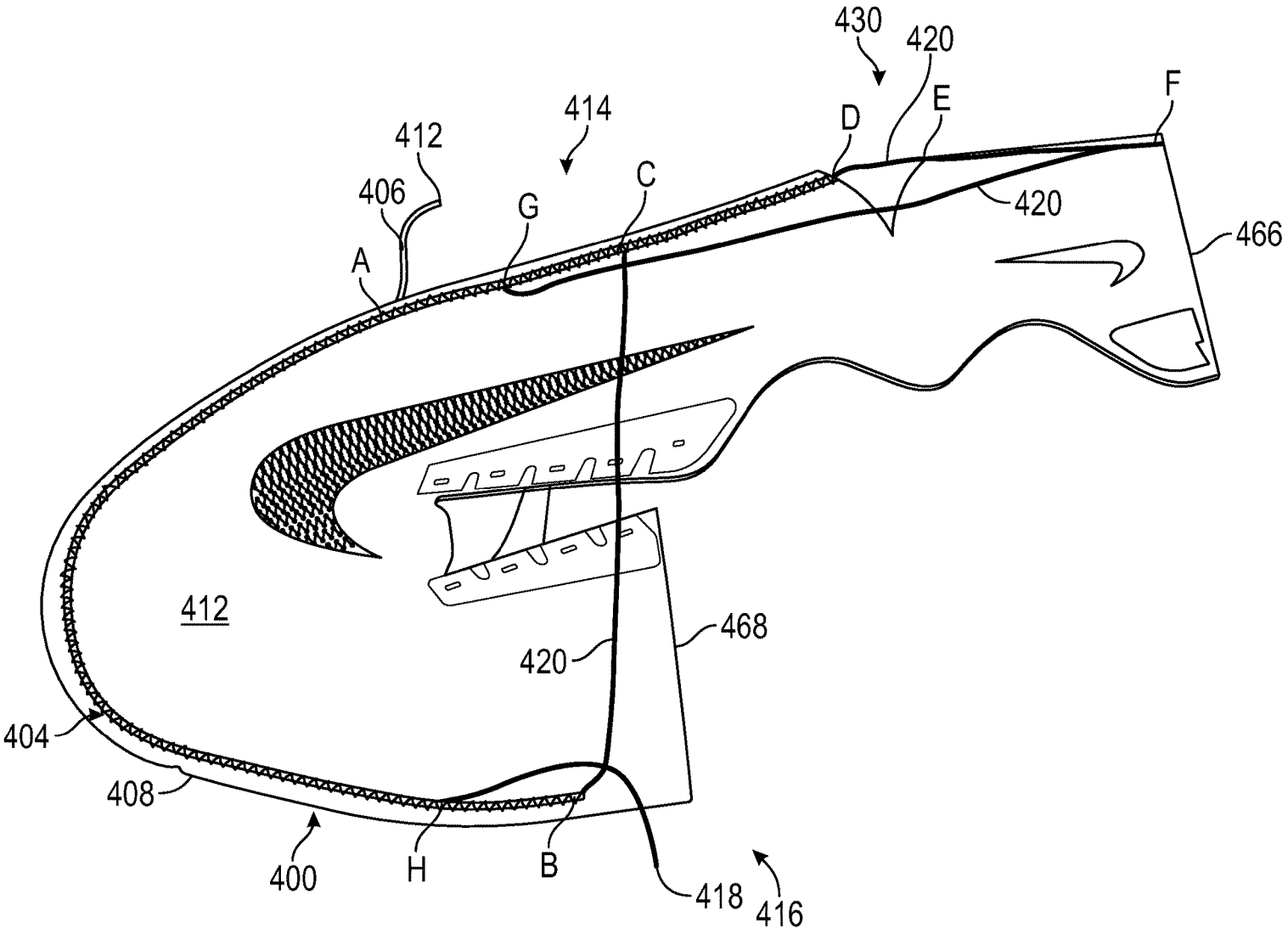
FIG. 8 illustrates another exemplary upper of an article of footwear in a flat orientation and with an exemplary gathering system.

FIG. 8 illustrates another exemplary gathering system 404 applied to another upper 400. As in other embodiments, the gathering string 406 is capture by a plurality of stitches that extend along outer perimeter; however, the upper 400 is constructed so that it is stitched together along a lateral or medial side, rather than at the heel.

In FIG. 8, an embroidery machine can begin capturing the gathering string 406 at location A on the first side 414 and continue in the direction of the arrows along the outer perimeter 408 in the forefoot region and continue on the second side 416 moving in the direction of the heel region. At location B, the gathering string 406 can move across the exterior surface 402 of the upper 400 back to the first side at location C. The gathering string 406 defines a first crossing portion 420 between locations B and C.

From location C, the gathering string 406 is captured along the outer perimeter 408 in the direction of heel region. At location D, near a heel end 430 of the first side 414 of the upper 400, the gathering string 406 can cross over the darted heel area to location E on the other side of the heel end 430, thereby forming a second crossing portion 420 between locations D and E.

From location E, the gathering string 406 is captured along the outer perimeter 408 until it reaches location F. At location F, the gathering string 106 can move back across the exterior surface of the upper to location G, thereby forming a third crossing portion 420 between locations F and G.

From location G, the gathering string 406 is captured along the outer perimeter 408 of the second side 414 moving again towards the forefoot region, along the outer perimeter 408 along the forefoot region 422 and back over to the second side 416 to a location H, with the second end 418 extending away from location H.

To form the upper of FIG. 8, first and second portions 466, 468 of the upper can be stitched together (either on a last or before applying to a last), the upper 400 can be positioned on a last and the crossing portions can be moved to the sole side of the upper 400. Thus, in construction, the crossing portion between B and C and the crossing portion between F and G extend across a midfoot region of the upper. The two ends 412, 418 of the gathering string 406 can be pulled to tighten the gathering string, which in turn pulls the outer perimeter of the upper 400 to conform to the shape of the last.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A method of forming of an upper of an article of footwear, comprising:

positioning the upper in a flat orientation;

securing a gathering string to the upper while in the flat orientation, the gathering string being secured along at least a portion of a perimeter of a first surface of the upper with a securing member that is attached to the upper, the gathering string being moveable relative to the securing member; and forming, while in the flat orientation, a plurality of crossing portions with the gathering string that extend from a first location along the perimeter of the upper at one of a medial side or lateral side to a second location along the perimeter of the upper at the other one of the medial side or lateral side such that the plurality of crossing portions extend across the first surface between the medial side and the lateral side, the plurality of crossing portions providing one or more intersection points where at least two of the plurality of crossing portions intersect with each other;

after forming the plurality of crossing portions in the flat orientation, manipulating the upper into a three-dimensional shape and positioning the upper on a last and moving the plurality of crossing portions away from the first surface of the upper so that the plurality of crossing portions extend across a bottom surface of the last; and applying tension to the gathering string to at least partially conform the upper to a shape of the last.

2. The method of claim 1, wherein the two or more crossing portions intersect in a midfoot region.

3. The method of claim 1, wherein the two or more crossing portions intersect in a midfoot region and in at least one of a forefoot region and heel region.

4. The method of claim 1, wherein the first location is on a medial side of the upper and the second location is on a lateral side of the upper.

5. The method of claim 1, wherein the upper comprises an exterior surface and an interior surface, and the first surface is the exterior surface.

6. The method of claim 1, further comprising moving the one or more crossing portions from a first location above the first surface of the upper to a second location below a bottom surface of the last, such that the one or more crossing portions extend across the bottom surface of the last.

7. The method of claim 1, wherein the securing member comprises a plurality of stitches that capture the gathering string along the at least a portion of the perimeter.

8. The method of claim 1, wherein the securing member extends along at least 50 percent of the perimeter of the upper.

9. The method of claim 1, wherein the securing member extends along at least 80 percent of the perimeter of the upper.

10. The method of claim 1, wherein the gathering string has a first portion that overlaps with a second portion along the perimeter of the upper at one or more overlapping portions.

11. The method of claim 10, wherein the overlapping portions of the gathering string are spaced apart from one another at the perimeter of the upper.

12. The method of claim 1, further comprising attaching a sole structure to the upper after applying tension to the gathering string.

13. The method of claim 1, further comprising removing at least a portion of the upper extending between the securing member and an edge of the perimeter of the upper.

14. The method of claim 1, wherein the securing member is positioned within at least 2 cm of an edge of the perimeter.

15. A method of forming of an article of footwear, comprising:

assembling an upper in a flat-forming process that comprises securing a gathering string to a perimeter of the upper while the upper is in a flat orientation, the gathering string being movable along the perimeter and forming two or more crossing portions that extend across a first surface of the upper between a first side and a second side of the upper, the two or more crossing portions providing at least one intersection point along the first surface of the upper;

after assembling the upper in the flat-forming process, manipulating the upper from the flat orientation into a three-dimensional shape and positioning the upper on a last with the two or more crossing portions below a bottom surface of the last; and applying tension to the gathering string to at least partially conform the upper to a shape of the last, wherein the first side is a medial side of the upper and the second side is a lateral side of the upper.

16. The method of claim 15, wherein applying tension to the gathering string causes the perimeter of the upper to conform to an adjacent surface of the last.

17. The method of claim 15, wherein the crossing portions extend from a first location on the first side to a second location on the second side, and the first and second locations are offset from one another relative to a longitudinal axis of the upper.

18. The method of claim 15, further comprising attaching a sole structure to the upper after applying tension to the gathering string.

* * * * *